US005276595A

United States Patent [19]

Patrie

[11] Patent Number: 5,276,595

[45] Date of Patent: Jan. 4, 1994

[54] COLOR-CODED TOILET LIGHT ASSEMBLY

[76] Inventor: Bryan J. Patrie, P.O. Box 576, Menlo Park, Calif. 94025

[21] Appl. No.: 12,426

[22] Filed: Feb. 2, 1993

[51] Int. Cl.[5] ..... F21V 33/00

[52] U.S. Cl. ..... 362/101; 362/184; 362/185; 362/253; 362/800; 4/661

[58] Field of Search ..... 362/101, 184, 185, 253, 362/800; 4/661

[56] References Cited

U.S. PATENT DOCUMENTS

| | | | |
|---|---|---|---|
| 4,413,364 | 11/1983 | Bittaker et al. | 4/661 |
| 4,733,419 | 3/1988 | Nee | 4/661 |
| 4,736,471 | 4/1988 | Johnson | 4/661 |
| 4,860,178 | 8/1989 | Picon | 362/101 |
| 5,003,648 | 4/1991 | Anderson | 4/661 |
| 5,036,443 | 7/1991 | Humble | 4/661 |

*Primary Examiner*—Carroll B. Dority

[57] ABSTRACT

A toilet light assembly for use at nighttime includes a toilet seat position sensor, a color-coded light comprised of two light sources each of a different color, a chime generator, a person sensor and a darkness sensor. When a person in darkness is sensed in the vicinity of the toilet, the assembly energizes the color-coded light in response to the toilet seat position sensor. If the seat is up, the toilet area is illuminated with red lighting and a brief chime is sounded. If the seat is down, the toilet area is quietly illuminated with green lighting. Thus the invention provides a colorful and unambiguous indicator of the position of the seat and provides a comfortable level of lighting to automatically facilitate nighttime use of the toilet.

9 Claims, 2 Drawing Sheets

COLOR-CODED TOILET LIGHT ASSEMBLY

FIELD OF INVENTION

This invention relates to a lighting means and, in particular, to a nighttime lighting means for a toilet.

PRIOR ART

Previous inventors have proposed numerous lights for the toilet area addressing the problem of normal bathroom lights being uncomfortably bright during visits to the bathroom in the middle of the night. However, there are numerous disadvantages to the prior art, as discussed below.

Bittaker et. al. of U.S. Pat. No. 4,413,364, Nee of U.S. Pat. No. 4,733,419, Picon of U.S. Patent 4,860,178, and Anderson of U.S. Pat. No. 5,003,648 all disclose lights for the toilet area which are de-energized when the toilet seat is in the down position. Unfortunately, the seat must be moved to the up position to energize these inventions, so the user must touch and manipulate the toilet to cause lighting. Furthermore, each invention requires the seat be stored in the down position to de-energize the light, whereas many bachelors and other people would prefer to store the seat in the up position. Furthermore, none of the inventions provide lighting of the toilet area when the seat is in the down position, and so the user cannot inspect the cleanliness of the seat before sitting. Furthermore, none of the inventions actively indicates that the seat is down, therefore if the batteries are dead and the seat has been left in the up position, one may mistakenly believe the seat is down, potentially leading to severe personal trauma.

Johnson of U.S. Pat. No. 4,736,471, and Humble et. al. of U.S. Pat. No. 5,036,443 disclose toilet lights which detect the position of the toilet lid and are de-energized when the lid is in the down position. Unfortunately, the lid must be moved to the up position to energize these inventions, so the user must touch and manipulate the toilet to cause lighting. Furthermore, each invention intends that the lid be stored in the down position to de-energize the light, whereas many people would prefer to store the lid in the up position. These inventions do not detect nor indicate the position of the seat, therefore the toilet user must focus his or her eyes and notice the seat position before using the toilet. Consequently, people without their corrective eyewear, which is often not worn at night, and people who are drowsy may mistake the position of the seat, potentially leading to severe personal trauma.

OBJECTS OF THE INVENTION

Accordingly, a principal object of the invention is to overcome the many disadvantages of the aforementioned prior art by providing a toilet light that detects the position of the toilet seat and provides color-coded lighting of the toilet area to indicate the position of the seat by the color of the provided lighting, perhaps accompanied by an audible indicator, so that people without their corrective eyewear and people who are drowsy can unerringly distinguish the position of the seat.

Another object of the invention is to provide a comfortable level of toilet area lighting for both positions of the seat to facilitate guidance of urine from the standing position when the seat is up, and to facilitate inspection of the cleanliness of the seat and the process of lowering oneself onto the seat when the seat is down.

Another object of the invention is to provide a toilet light having low power consumption so that it can be battery operated without frequent battery changes and without the need to disconnect the battery during the day.

Another object of the invention is to provide a toilet light that actively indicates both positions of the seat so that dead batteries cannot lead to misinterpretation of the seat position.

Another object of the invention is to provide a toilet light that does not require the toilet seat be moved to or stored in a particular position to energize or de-energize the light.

Another object of the invention is to provide a toilet light that is automatically energized when a person enters a dark bathroom, and automatically de-energized after the person leaves.

Another object of the invention is to provide a toilet light that can be conveniently attached to existing toilets or incorporated into new toilet designs.

Further objects and advantages will become apparent from a consideration of the ensuing description and the accompanying drawings.

DRAWING FIGURES

Figure 3A:
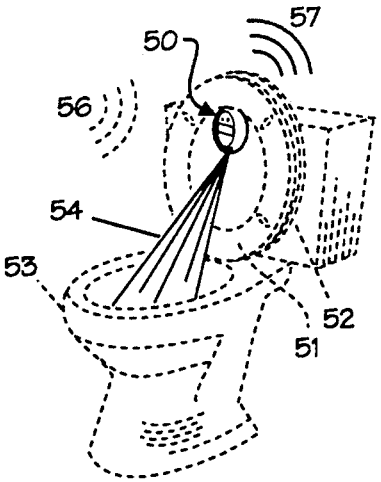

FIG. 3*a* is a perspective view of the operation of the invention with the toilet seat in the up position.

Figure 3B:
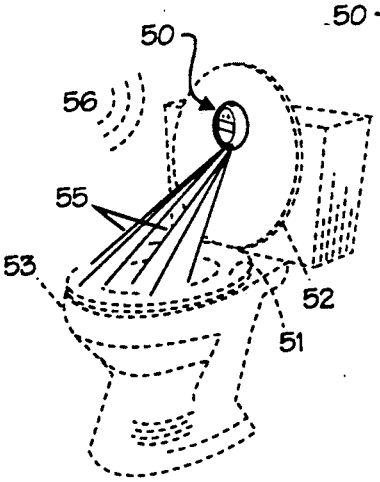

FIG. 3*b* is a perspective view of the operation of the invention with the toilet seat in the down position.

Figure 4:
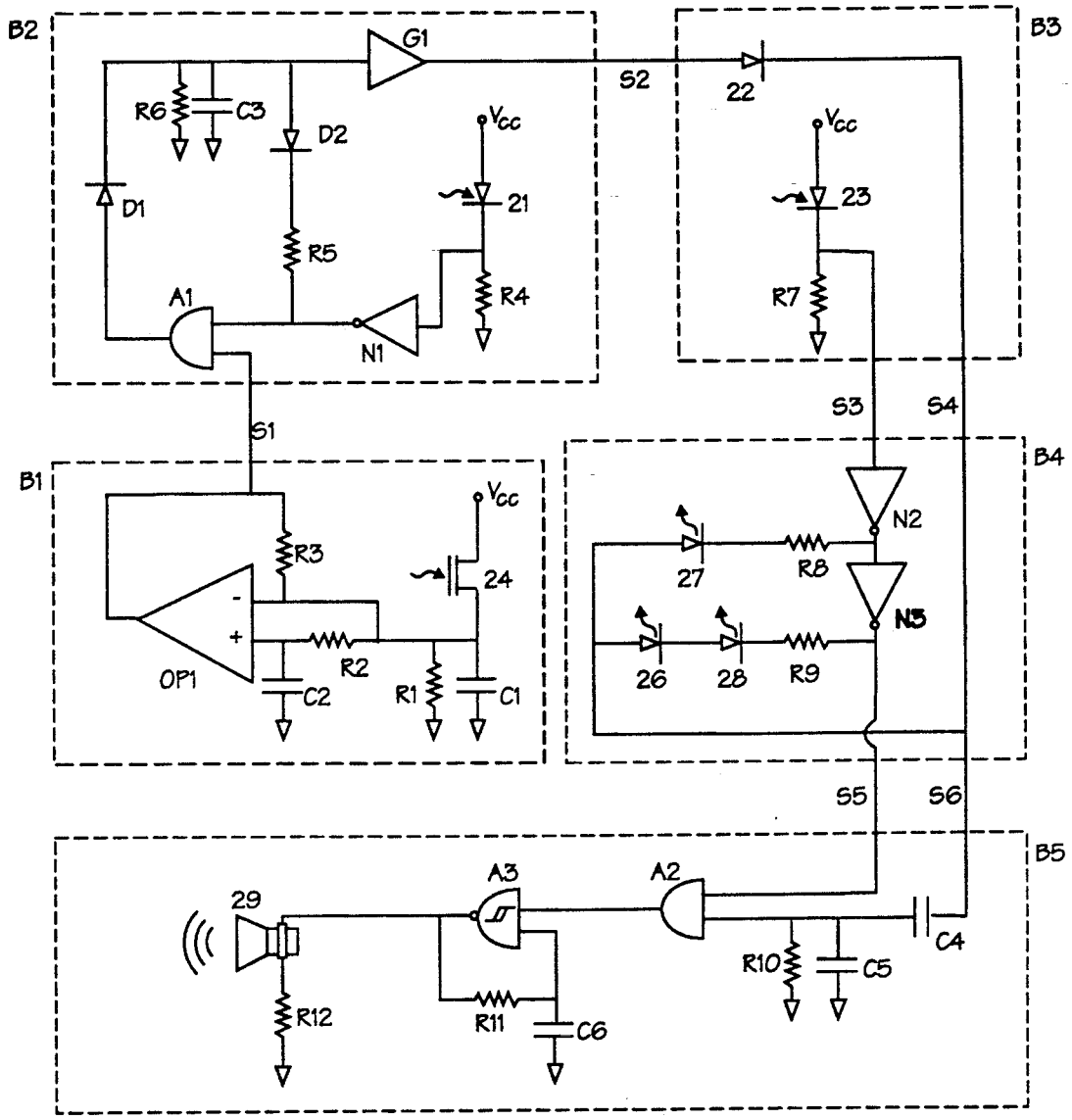

FIG. 4 is an electrical schematic of the invention.

LIST OF REFERENCE NUMBERS

10 - housing
11 - window for infrared emitter
12 - window for infrared receiver
13 - threaded stem
14 - window for red LED
15 - window for green LED
16 - window for green LED
17 - product label
18 - window for body heat sensor
19 - window for darkness sensor
20 - electrical circuit
21 - darkness sensor
22 - infrared emitter
23 - infrared receiver
24 - body heat sensor
25 - battery
26 - red LED
27 - green LED
28 - green LED
29 - speaker
30 - housing base
31 - base hole
32 - attachment tape
33 - restricted view
50 - invention
51 - toilet seat
52 - toilet lid
53 - toilet bowl
54 - red lighting
55 - green lighting
56 - body heat
57 - chime

DESCRIPTION OF INVENTION

Figure 1:
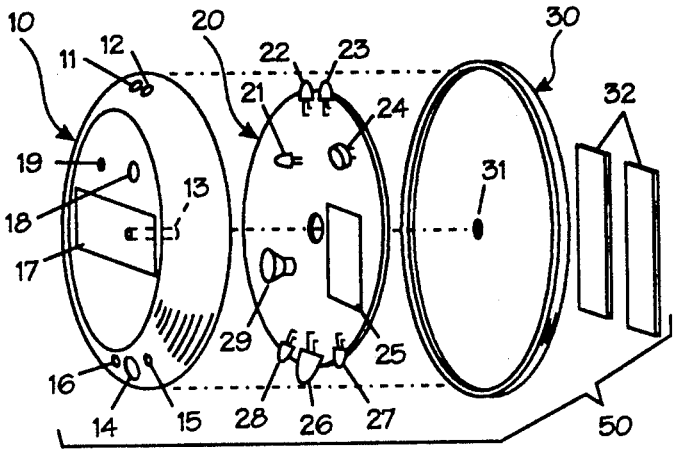
FIG. 1 is an exploded view of the invention.

FIG. 1—Exploded View of Invention

FIG. 1 shows an exploded view of the preferred embodiment of the invention 50 comprised of a housing 10, an electrical circuit 20, and a housing base 30.

The housing has numerous windows or holes to permit optical access of various components of the electrical circuit. The electrical circuit includes a color-coded multi-colored light comprised of a red light-emitting diode (LED) 26 and two green LEDs 27 and 28 which peer through windows 14, 15 and 16 on the housing, respectively. The red LED serves as a seat-up indicator light. The red LED also provides area lighting to facilitate use of the toilet when the seat is in the up position. A speaker 29 may be included to emit a sound such as a brief audible chime or a synthesized voice when the red LED is first energized to further indicate that the seat is up. In contrast, the two green LEDs serve as a seat-down indicator light. The green LEDs also provide area lighting to facilitate inspection of the seat before sitting when the seat is in the down position. Thus the color-irrelevant lighting of prior art is replaced by a color-coded light. The LEDs are preferred over incandescent light sources since the LEDs offer ample area lighting in a darkened bathroom, high energy efficiency and distinct colors. One red LED and two green LEDs are used in this embodiment for aesthetic reasons; the color of the LEDs and the number of each color is optional. For example, a single bi-color LED may be used.

A position sensor comprised of a mechanical switch or a proximity sensor is used to detect the position of the toilet seat. The preferred proximity sensor is a reflective switch comprised of an infrared emitter 22, such as an infrared LED, and an infrared receiver 23, such as an infrared photodiode, which peer through windows 11 and 12 on the housing, respectively. The operation of the reflective switch is detailed later, though basically stated, if the seat is in the up position, infrared energy from the emitter will be reflected by the seat and detected by the receiver. Other proximity sensors could be used, such a Hall-effect switch, or a magnetic switch (for example, if the seat were custom-made, a magnet could be embedded in the seat). However, the reflective switch is the preferred position sensor since it is inexpensive and requires no physical contact with the seat and so cannot cause scratching or other seat damage.

The color-coded light is normally de-energized. A person sensor such as the type commonly used in passive infrared home security systems, or such as a sonic sensor, or such as an electrostatic sensor, is used to trigger the light. The preferred embodiment uses a body heat sensor 24 and a window 18 on the housing to permit infrared body heat to access the sensor. The operation of the body heat sensor is detailed later, though basically stated, when the sensor detects the presence of a person in the vicinity of the toilet, the sensor triggers the invention to properly energize the color-coded light, though only if ambient darkness has been detected.

To detect ambient darkness, a window 19 on the housing permits room lighting access a darkness sensor 21, such as a visible-wavelength photodiode. The darkness sensor is detailed later, though basically stated, the sensor disables the color-coded light if room lighting is detected since room lighting indicates it is daytime and so obviates the need for the invention. In one version of the invention (not shown in the illustrated embodiment), a dimly flashing LED is energized to indicate darkness.

To power the invention, a battery 25 is carried within the housing. With the micropower CMOS electrical circuit described later, a single 9-Volt alkaline battery (typically a 500 mAh energy supply) can power this invention for over a year of normal service. The invention needs no manual on-off switch to disconnect the battery during the day since the battery life is adequate without such measures.

To assemble the invention, a threaded stem 13 carried on the housing passes to the base hole 31 which is threaded to accept the stem. The housing also carries a product label 17 to display a product logo and product information.

Figure 2:
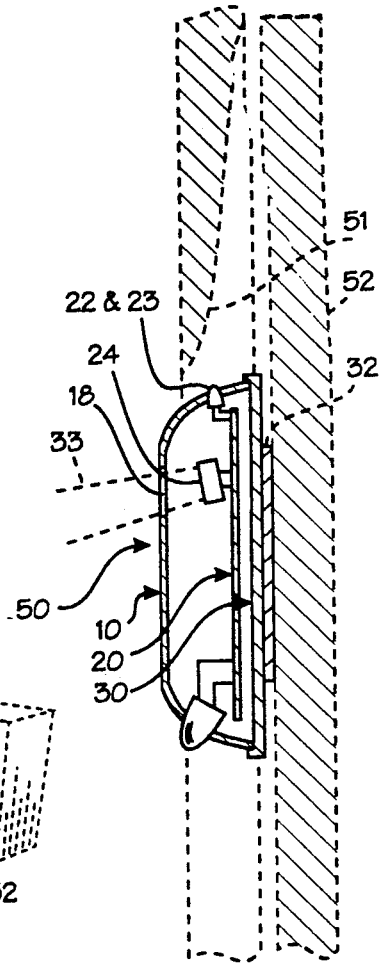
FIG. 2 is a side view of the invention installed on a typical toilet.

FIG. 2—Mounting Detail/Sensor Operation

FIG. 2 is a side view detailing the position of the invention with the toilet seat 51 and lid 52 in the up position. As shown in FIG. 2 (preview also FIG. 3*a*), the invention is attached to the under side of the toilet lid so as to be approximately trained by the opening in the toilet seat. Mounting is accomplished by means of attachment tape 32 which may be double-sided sticky tape connected between the housing base and the lid. As shown in FIG. 2, the exact location of the invention and the aim of the reflective switch are such that when the seat is in the up position, the seat can substantially reflect emissions from the infrared emitter 22 back into the infrared receiver 23. Substantial reflections indicate the seat is up, while no such reflections indicate the seat is down. A mechanical switch could be used in place of the reflective switch.

FIG. 2 also shows the orientation of the body heat sensor 24. The body heat sensor sits within the housing behind and away from a window 18 on the housing so as to provide a restricted view 33 of the area of the bathroom immediately in front of the toilet. This restricted view or tunnel vision provides a sudden flux of body heat to the sensor only when a person steps in front of the toilet. With this unusual arrangement of the body heat sensor, the invention can be triggered only when a person steps into the immediate vicinity of the toilet.

FIGS. 3*a* and 3*b*—Seat-Up and Seat-Down Operation

When the toilet seat 51 is in the up position, as shown in FIG. 3*a*, a person triggering the invention with body heat in a dark bathroom will cause the red LED to be energized, and if included in the circuit, an audible chime 57 will briefly sound. The red LED is directed to illuminate the toilet bowl 53 with red lighting to indicate that the seat is up and to provide comfortable lighting for standing urination or for grasping the seat and moving it to the down position. The color-coded light remains energized for several minutes.

When the toilet seat is in the down position, as shown in FIG. 3*b*, a person triggering the invention with body heat in a dark bathroom will cause the green LEDs to energize. The green LEDs are directed to illuminate the toilet seat 51 with green lighting 55 to quietly call attention to the fact that the seat is down and to provide comfortable lighting for inspecting the cleanliness of the seat or for grasping the seat and moving it to the up position. Again, the color-coded light remains energized for several minutes.

If the seat is moved to a new position while the color-coded light is energized, the color-coded light will change color. However, if the seat is moved from the down to the up position thereby de-energizing the green LEDs and energizing the fed LED, the chime does not sound since the user is obviously already aware of the position of the seat. The chime should briefly sound only if the invention is triggered with the seat in the up position.

FIG. 4—Electrical Schematic of Invention

The electrical schematic of the invention shown in FIG. 4 is comprised of five functional blocks: person sensor block B1, darkness sensor block B2, position sensor block B3, color-coded light block B4, and chime generator block B5. The circuit is driven by a battery with supply voltage Vcc.

Block B1 provides person sensing using a body heat sensor 24 such as Heimann's LHi 807 single-element pyroelectric sensor or the LHi 958 opposite-polarity twin-element pyroelectric sensor. To use opposite-polarity twin-element sensors, one of the elements should be covered with opaque paint or tape. The signal from the pyroelectric sensor is amplified by a low-power CMOS amplifier OP1 such as Texas Instruments' TLC27L2 micropower operational amplifier used in conjunction with resistors R1 through R3 and capacitors C1 and C2; many other body heat detection circuits are possible. When a sufficient increase in body heat is detected, line S1 goes logically high.

Most pyroelectric sensors are manufactured so they detect only changes in the incident body heat. Because a person is typically stationary while urinating, such sensors detect only the initial appearance of the person. For this reason, the present invention uses a timer to energize the color-coded light for several minutes after the initial appearance of the person is detected. In this way, if the person becomes stationary after triggering the invention, the color-coded light will be energized for a timed period sufficiently long for normal urination.

Block B2 provides both darkness detection and timing. In the absence of room lighting, the darkness sensor 21 inhibits current from flowing through resistor R4, and so the output of inverter N1 sits logically high thereby enabling AND gate A1 to respond to changes in line S1. When body heat is detected in block B1, line S1 and the AND gate output go logically high. The AND gate output charges timing capacitor C3. After line S1 and the AND gate output go low because the user is stationary (see previous paragraph), the timing capacitor slowly drains through resistor R6, meanwhile maintaining a logically high input to the buffer gate G1. During the timed period, electrical current flows out line S2. The duration of the timed period is controlled by the timing capacitor and resistor R6. The buffer gate G1 should be of the CMOS type with high input impedance so the timing capacitor cannot drain into the buffer gate. Diode D1 is necessary to prevent the timing capacitor from draining back into the AND gate. Note that diode D2 and resistor R5 discharge the timing capacitor if the bathroom lights are turned on.

Block B3 determines the position of the toilet seat using a position sensor comprised of a reflective switch. Electrical current supplied by line S2 energizes the infrared emitter 22. If the toilet seat is in the up position, infrared energy reflected by the seat is detected by the infrared receiver 23 which then drives current through resistor R7. Line S3 goes logically high if the seat is up, logically low if the seat is down.

Block B4 energizes either the seat-up or the seat-down indicator light. If the toilet seat is up making line S3 logically high, the inverter N2 pulls electrical current through the red LED 27 and through a current-limiting resistor R8. If the toilet seat is down making line S3 logically low, the inverter N3 pulls electrical current through the green LEDs 26 and 28 and a current-limiting resistor R9. Line S4 supplies electrical current to energize this block.

Block B5 emits a brief audible chime if the invention is triggered with the seat in the up position. Capacitor C4 should be approximately ten times the capacitance of capacitor C5 so that when line S6 goes logically high (when the invention is first triggered), capacitor C5 will become almost fully charged thereby making logically high the corresponding input to AND gate A2. The remaining input to AND gate A2 checks the position sensor using line S5. If the seat is in the up position, the output of AND gate A2 goes logically high and thus enables AND gate A3 which is Schmitt-triggered and is connected as a single-gate oscillator. The frequency of the oscillation is controlled by resistor R11 and capacitor C6. The oscillating output of the AND gate A3 drives the speaker 29 to emit an audible chime. The duration of the chime is controlled by capacitor C5 and resistor R10. The volume of the chime is controlled by resistor R12.

SUMMARY, RAMIFICATIONS, AND SCOPE

The color-coded toilet light assembly described herein blatantly indicate the position of the toilet seat by the color of the provided area lighting. Whereas people not wearing their corrective eyewear at night and people who are drowsy may mistake the position of the toilet seat even with adequate color-irrelevant lighting, the color-coded toilet light unambiguously solves this problem. By adding an audible chime to accompany the seat-up indicator light, the invention virtually precludes the possibility of sitting on the toilet without first noticing the position of the seat. Furthermore, the color-coded toilet light assembly provides area lighting for both positions of the seat. Furthermore, by triggering the invention with a person sensor, the invention does not require the seat be moved to or stored in any particular position to energize or de-energize the light. And by actively indicating both positions of the seat, dead batteries will not lead to misinterpretation of the seat position. Clearly, the color-coded toilet light assembly provides an unambiguous indicator of the seat position and colorfully overcomes the numerous disadvantages of the prior art.

While several specific embodiments of the color-coded toilet light assembly have been discussed, other variations in the construction and placement of the invention can be made to provide equivalent inventions. There will be other changes, modifications and substitutions which are considered to be within the scope of the present invention, as set forth in the appended claims. Therefore the scope of the invention should be determined by the appended claims and their legal equivalents, and not by the examples given.

I claim:

1. A light assembly for use with a toilet having a toilet seat and a toilet lid, said seat and said lid being pivotable between a substantially horizontal down position and a substantially vertical up position, said light assembly comprising:

(a) a housing and means for attaching said housing to said lid such that said housing is approximately framed by the opening in said seat when the seat and lid are in the up position;

(b) a color-coded light mounted in said housing, said color-coded light comprising a seat-up indicator light and a seat-down indicator light, the emitted color of said seat-up indicator light being substantially different than the emitted color of said seat-down indicator light;

(c) a position sensor means mounted in said housing for detecting the seat in the up position, said position sensor means comprising a mechanical switch or a proximity sensor;

(d) a person sensor means mounted in said housing for detecting a person in the vicinity of the toilet;

(e) a battery and electrical circuit means mounted in said housing for energizing said color-coded light if said person has been detected such that said seat-up indicator light is energized if the seat is detected in said up position, and such that said seat-down indicator light is energized if the seat is not detected in said up position.

2. The light assembly of claim 1 wherein said person sensor means comprises a body heat sensor positioned within said housing behind and away from a window on said housing so as to provide said body heat sensor with tunnel vision of the bathroom area adjacent to the toilet, whereby a person can be detected only if said person has entered said area.

3. The light assembly of claim 1 further including a speaker means such that sound is generated when said seat-up indicator light is energized whereby said sound additionally indicates that the seat is in said up position.

4. The light assembly of claim 1 further including a darkness sensor so as to prevent energizing of said color-coded light if room lighting is detected.

5. A light assembly for use with a toilet having a toilet seat and a toilet lid, said seat and said lid being pivotable between a substantially horizontal down position and a substantially vertical up position, said light assembly comprising:

(a) a housing and means for attaching said housing to said lid;

(b) a color-coded light mounted in said housing, said color-coded light comprising a seat-up indicator light and a seat-down indicator light, the emitted color of said seat-up indicator light being substantially different than the emitted color of said seat-down indicator light;

(c) a position sensor means for detecting said positions of said seat;

(d) a person sensor means for detecting a person in the vicinity of said toilet;

(e) a battery and electrical circuit means for energizing said color-coded light if said person is detected such that said seat-up indicator light is energized if the seat is in said up position, and such that said seat-down indicator light is energized if the seat is in said down position.

6. The light assembly of claim 5 wherein said person sensor means comprises a body heat sensor positioned within said housing behind and away from a window on said housing so as to provide said body heat sensor with tunnel vision of the bathroom area adjacent to the toilet, whereby a person can be detected only if said person has entered said area.

7. The light assembly of claim 5 further including a speaker means such that sound is generated when said seat-up indicator light is energized whereby said sound additionally indicates that the seat is in said up position.

8. The light assembly of claim 5 further including a darkness sensor so as to prevent energizing of said color-coded light if room lighting is detected.

9. A light assembly for use with a toilet having a toilet seat and a toilet lid, said seat and said lid being pivotable between a substantially horizontal down position and a substantially vertical up position, said light assembly comprising:

(a) a housing and means for attaching said housing within the vicinity of said toilet;

(b) a multi-colored light means mounted in said housing;

(c) a position sensor means for detecting the position of said seat;

(d) an electrical circuit means for energizing said multi-colored light means such that light of one color is emitted if the seat is in said up position, and such that light of another color is emitted if the seat is in said down position.

* * * * *